US011828520B2

(12) United States Patent
Boiter et al.

(10) Patent No.: US 11,828,520 B2
(45) Date of Patent: Nov. 28, 2023

(54) RADIAL FAN ASSEMBLY

(71) Applicant: Electrolux Home Products, Inc., Charlotte, NC (US)

(72) Inventors: Shawn Boiter, Easley, SC (US); Gary Doyon, Anderson, SC (US); Kevin Cobb, Easley, SC (US); William Rabon, Pendleton, SC (US)

(73) Assignee: Electrolux Home Products, Inc., Charlotte, NC (US)

( * ) Notice: Subject to any disclaimer, the term of this patent is extended or adjusted under 35 U.S.C. 154(b) by 136 days.

(21) Appl. No.: 17/117,646

(22) Filed: Dec. 10, 2020

(65) Prior Publication Data

US 2022/0187006 A1 Jun. 16, 2022

(51) Int. Cl.
*F25D 17/06* (2006.01)
*F25D 11/02* (2006.01)
*F25D 17/08* (2006.01)

(52) U.S. Cl.
CPC ..... *F25D 17/067* (2013.01); *F25D 11/02* (2013.01); *F25D 17/08* (2013.01)

(58) Field of Classification Search
CPC ..... F25D 17/067; F25D 11/02; F25D 17/08
See application file for complete search history.

(56) References Cited

U.S. PATENT DOCUMENTS

2009/0038334 A1* 2/2009 Konig ..... F25B 39/02 62/515
2018/0231297 A1* 8/2018 Yoo ..... F25D 17/067
2019/0264972 A1* 8/2019 Kim ..... F25D 11/02
2019/0360740 A1* 11/2019 Han ..... F25D 11/02
2021/0108694 A1 4/2021 Mayer et al.
2021/0172670 A1* 6/2021 Lee ..... F25D 17/065

FOREIGN PATENT DOCUMENTS

CH 713416 A2 * 8/2018 ..... F16B 21/06
DE 102016220191 A1 * 4/2018 ..... F16F 3/0876
KR 20110020482 3/2011
KR 2014123814 A * 10/2014
WO 2018192758 10/2018

OTHER PUBLICATIONS

Translated_Ho (Year: 2014).*
Translated_Martin (Year: 2018).*
Translated_Diana (Year: 2018).*

* cited by examiner

*Primary Examiner* — Elizabeth J Martin
*Assistant Examiner* — Samba Gaye
(74) *Attorney, Agent, or Firm* — Pearne & Gordon LLP

(57) ABSTRACT

A fan assembly including an air duct; an evaporator coil cover; a radial fan mounted onto the evaporator coil cover and disposed between the air duct and the evaporator coil cover; wherein the air duct includes a ring portion which interlocks with the evaporator coil cover around the radial fan; wherein the evaporator coil cover comprises three darts positioned substantially uniformly around the radial fan position; three grommets, each grommet having a central opening configured to fit over a dart, each grommet having a circumferential ridge configured to interlock with a lower rim or the radial fan is provided. Further provided is a method of reducing noise in a refrigeration appliance.

13 Claims, 8 Drawing Sheets

RADIAL FAN ASSEMBLY

FIELD OF INVENTION

The instant invention relates to a radial fan assembly for use with an evaporator in an appliance.

BACKGROUND OF THE INVENTION

Conventional refrigerating appliances, such as domestic refrigerators, typically have both a fresh food compartment and a freezer compartment or section. The fresh food compartment is where food items such as fruits, vegetables, and beverages are stored. The freezer compartment is where food items that are to be kept in a frozen condition are stored. The refrigerating appliances are provided with refrigeration systems that maintains the fresh food compartment at temperatures above 0° C., such as between 0.25° C. and 4.5° C. and the freezer compartments at temperatures below 0° C., such as between 0° C. and −20° C.

Such appliances are often provided with an evaporator fan for urging air over an evaporator coil. Such fans have been axial fans which pose issues with noise and vibrations. The mounting of the fans has also involved a number of steps and a multiplicity of parts complicating the assembly of the appliance.

SUMMARY OF THE INVENTION

The instant invention is an assembly for a radial fan for urging air over an evaporator coil used in an appliance, particularly a refrigerating appliance.

In a first embodiment, the invention provides a fan assembly comprising an air duct; an evaporator coil cover; a radial fan mounted onto the evaporator coil cover and disposed between the air duct and the evaporator coil cover; wherein the air duct includes a ring portion which interlocks with the evaporator coil cover around the radial fan; wherein the evaporator coil cover comprises three darts positioned substantially uniformly around the radial fan position; three grommets, each grommet having a central opening configured to fit over a dart, each grommet having a circumferential ridge configured to interlock with a lower rim or the radial fan.

In a particular embodiment of the fan assembly, each dart is positioned at an angle of from 5 to 30 degrees, or alternatively, at an angle of from 15 to 25 degrees, with respect to a normal to an outer circumference of the radial fan.

In yet another embodiment, the invention provides the fan assembly according to any of the foregoing embodiments, and wherein the grommets are made of an elastomer material.

In yet another embodiment, the invention provides the fan assembly according to any of the foregoing embodiments, and wherein the grommets are made of rubber.

In yet another embodiment, the invention provides the fan assembly according to any of the foregoing embodiments, and wherein the darts comprise a horizontal rail from which a vertical rail extends upward, a cap covering a top surface of the vertical rail and extending inwardly toward the radial fan past the vertical rail, such that the cap assists in holding the grommet in place, and a support boss extending upwardly from the horizontal rail along a back portion of the vertical rail.

In yet another embodiment, the invention provides the fan assembly according to any of the foregoing embodiments, and wherein the horizontal rail is integrally formed onto the evaporator coil cover and the vertical rail is integrally formed with the horizontal rail.

In yet another embodiment, the invention provides the fan assembly according to any of the foregoing embodiments, and wherein the fan is mounted to the evaporator coil cover without the use of screws.

In yet another embodiment, the invention provides the fan assembly according to any of the foregoing embodiments, and wherein the air duct is made of expanded polystyrene.

In yet another embodiment, the invention provides the fan assembly according to any of the foregoing embodiments, and wherein the air duct is made of expanded polypropylene.

In yet another embodiment, the invention provides the fan assembly according to any of the foregoing embodiments, and wherein the ring portion of the duct cover comprises an opening.

In yet another embodiment, the invention provides the fan assembly according to any of the foregoing embodiments, and wherein the ring portion of the duct cover has an opening of between 50 and 100 mm.

In yet another embodiment, the invention provides the fan assembly according to any of the foregoing embodiments, and wherein a depth of the ring portion of the duct cover is between 1 and 12 mm.

In yet another embodiment, the invention provides a method of reducing noise in a refrigeration appliance comprising the steps of providing a radial evaporator fan; housing the radial evaporator fan in a mounting assembly which comprises an air duct and an evaporator coil cover, wherein the air duct includes a ring portion which interlocks with the evaporator coil cover around the radial fan; wherein the evaporator coil cover comprises three integrally formed darts positioned substantially uniformly around the radial fan position and wherein the radial fan is attached to the evaporator coil cover by way of three rubber grommets, each grommet having a central opening configured to fit over a dart, each grommet having a circumferential ridge configured to interlock with a lower rim or the radial fan, wherein each dart is positioned at an angle of from 5 to 30 degrees with respect to a normal to an outer circumference of the radial fan.

In another embodiment, the invention provides the method of reducing noise in a refrigeration appliance as described above and further comprising the step of varying the speed of the radial evaporator fan.

In yet another embodiment, the invention provides the cover comprises method of reducing noise in a refrigeration appliance according to any of the foregoing embodiments, and wherein the radial evaporator fan is not cycled on and off during operation.

In yet another embodiment, the invention provides a refrigerator comprising the fan assembly according to any of the foregoing embodiments.

BRIEF DESCRIPTION OF THE DRAWINGS

For the purpose of illustrating the invention, there is shown in the drawings a form that is presently preferred; it being understood, however, that this invention is not limited to the precise arrangements and instrumentalities and scale shown.

DETAILED DESCRIPTION OF EMBODIMENTS OF THE INVENTION

Figure 1:
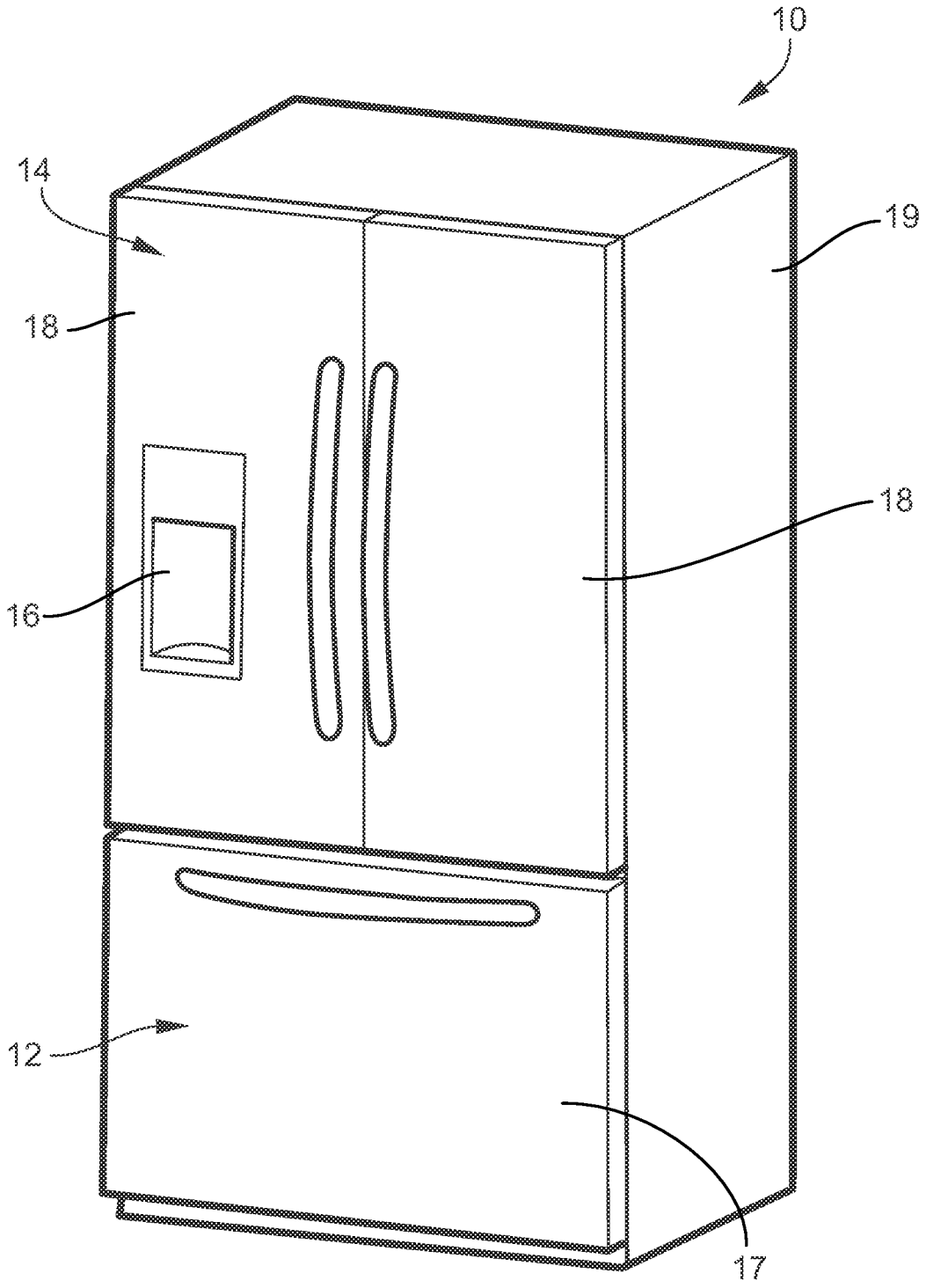
FIG. 1 PRIOR ART
FIG. 1 is a front perspective view of a prior art household refrigeration appliance showing doors of the fresh food and freezer compartments in closed positions.

Embodiments of a refrigerating appliance or a component thereof now will be described with reference to the accompanying drawings. Whenever possible, the same reference numerals are used throughout the drawings to refer to the same or like parts.

Referring to FIG. 1, a prior art household refrigeration appliance is indicated generally at 10. Although the detailed description that follows concerns a domestic refrigerator 10, the invention can be embodied by refrigeration appliances other than with a household refrigerator 10. Further, an embodiment is described in detail below, and shown in the figures as a bottom-mount configuration of a refrigerator 10, including a fresh food compartment 14 disposed vertically above a freezer compartment 12. However, the refrigerator 10 can have any desired configuration including at least a fresh food compartment 14 and a dispenser 16, such as a top mount refrigerator (freezer disposed above the fresh food compartment), a side-by-side refrigerator (fresh food compartment is laterally next to the freezer compartment), a standalone refrigerator or freezer, etc.

One or more doors 18 shown in FIG. 1 are pivotally coupled to a cabinet 19 of the refrigerator 10 to restrict and grant access to the fresh food compartment 14. The door can include a single door that spans the entire lateral distance across the entrance to the fresh food compartment 14, or can include a pair of French-type doors 18 as shown in FIG. 1 that collectively span the entire lateral distance of the entrance to the fresh food compartment 14 to enclose the fresh food compartment 14. In the refrigerating appliance configuration shown in FIG. 1, the freezer compartment 12 is positioned under the fresh food compartment 14. The freezer compartment is enclosed in this instance by a slidable door 17.

Figure 2:
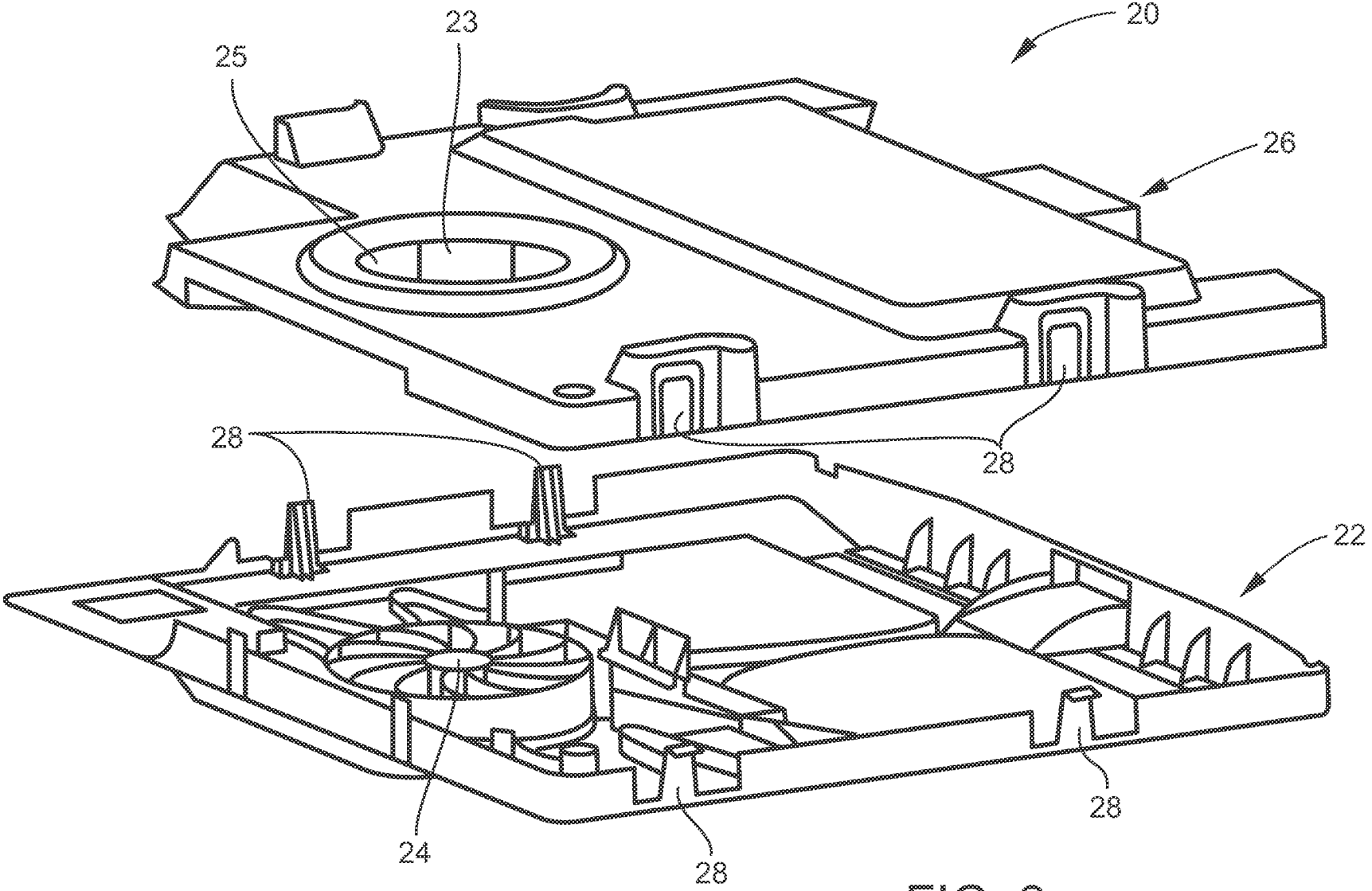
FIG. 2 is a perspective, partially exploded view of a first embodiment of a fan assembly of the present invention.

On embodiment of the inventive fan assembly 20 is show in FIG. 2, in partially exploded view. The fan assembly 20 includes an evaporator coil cover 22, a radial fan 24 removably mounted onto the evaporator coil cover 22, and an air duct 26. Air duct 26 is shown above the evaporator coil cover 22 and radial fan 24 although in assembled form, air duct 26 is placed immediately on top of the evaporator coil cover 22 and snapped into place using a plurality of interlocking clips 28. While interlocking clips are illustrated, other permanent and releasable connecting devices or methods may be used, such as screws, fasteners, and adhesives.

Air duct 26 is sized to align with and interlockedly connect to the evaporator coil cover 22. The air duct 26 comprises an opening 23. On an interior surface of the air duct 26, a ring 25 projects around the opening 23. Ring 25 may form a continuous ring around the opening or may be discontinuous, as shown in FIG. 2. Air duct 26 may, in some embodiments, be formed of an expanded polystyrene or an expanded polypropylene. Opening 23, in some embodiments, may have a diameter of between 50 and 100 mm. All values and subranges from 50 to 100 mm are disclosed and included herein. For example, the diameter of opening 23 may range from a lower limit of 50, 52, 55, 60, 66, or 70 mm to an upper limit of 65, 69, 74, 77, 82, 88, 95, or 100 mm. For example, the diameter of opening 23 may range from 50 to 100 mm, or in the alternative, from 55 to 96 mm, or in the alternative from 65 to 98 mm, or in the alternative, from 70 to 90 mm, or in the alternative from 68 to 92 mm. A depth, distance of extension from the interior surface of the air duct, of the ring 25 may range, in some embodiments, from 1 and 12 mm. All values and subranges from 1 to 12 mm are disclosed and included herein. For example, the ring depth may vary from a lower limit of 1, 2, 3.3, 4.6, 5, or 6 mm to an upper limit of 7, 8.1, 9.2, 10.3, 11.4 or 12 mm. For example, the ring depth may range from 1 to 12 mm, or in the alternative from 2 to 10 mm, or in the alternative from 2.5 to 9.6 mm, or in the alternative from 6 to 10 mm.

Figure 3:
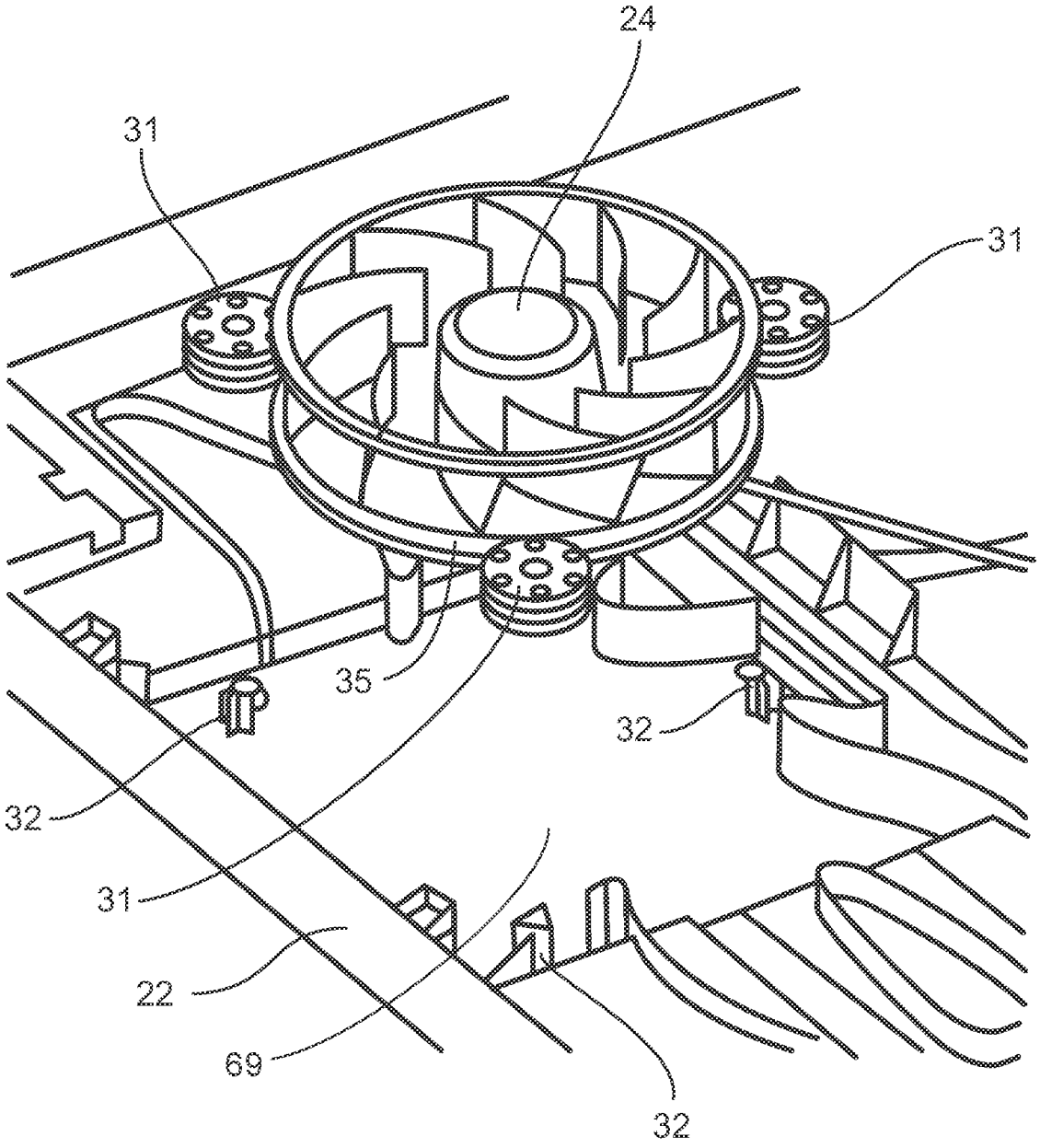
FIG. 3 is a perspective, partially exploded enlarged view of the radial fan and evaporator coil cover of the embodiment shown in FIG. 2.

FIG. 3 illustrates a portion of the evaporator coil cover 22 where the radial fan 24 and grommets 31 are shown in exploded view. Further shown in FIG. 3 are darts 32 which are integrally formed onto or removably attached to an interior surface of the evaporator coil cover 22. In assembled condition, grommets 31 are placed onto darts 32, as shown in more detail below.

Figure 4:
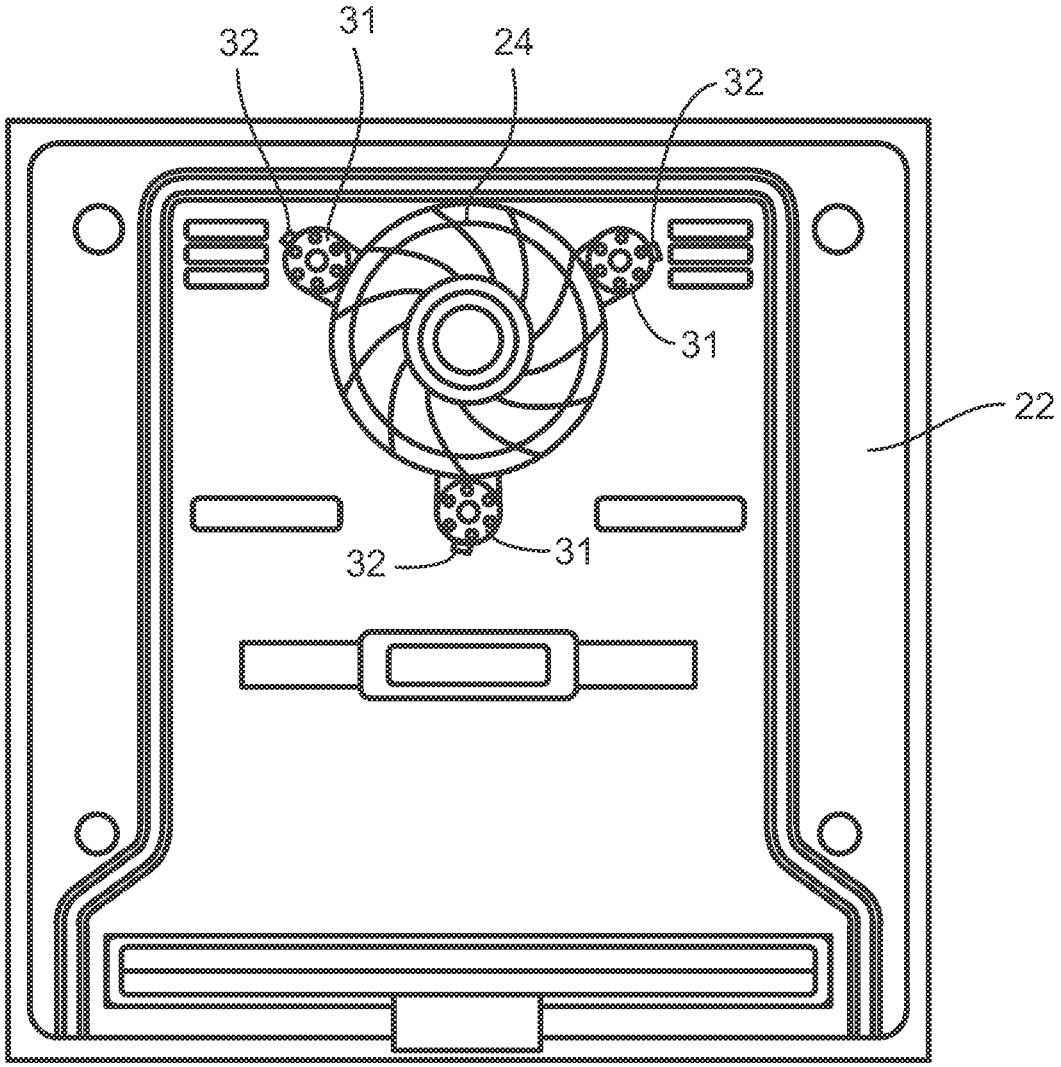
FIG. 4 is a front elevational view of an evaporator coil cover, radial fan and grommets of an embodiment of the inventive fan assembly.

FIG. 4 illustrates the evaporator coil cover 22 with the radial fan 24 installed and help in place by grommets 31 which are installed on darts 32. In a particular embodiment, the radial fan 24 is held in place on the evaporator coil cover 22 in the absence of screws, rivets or similar fasteners.

Figure 8:
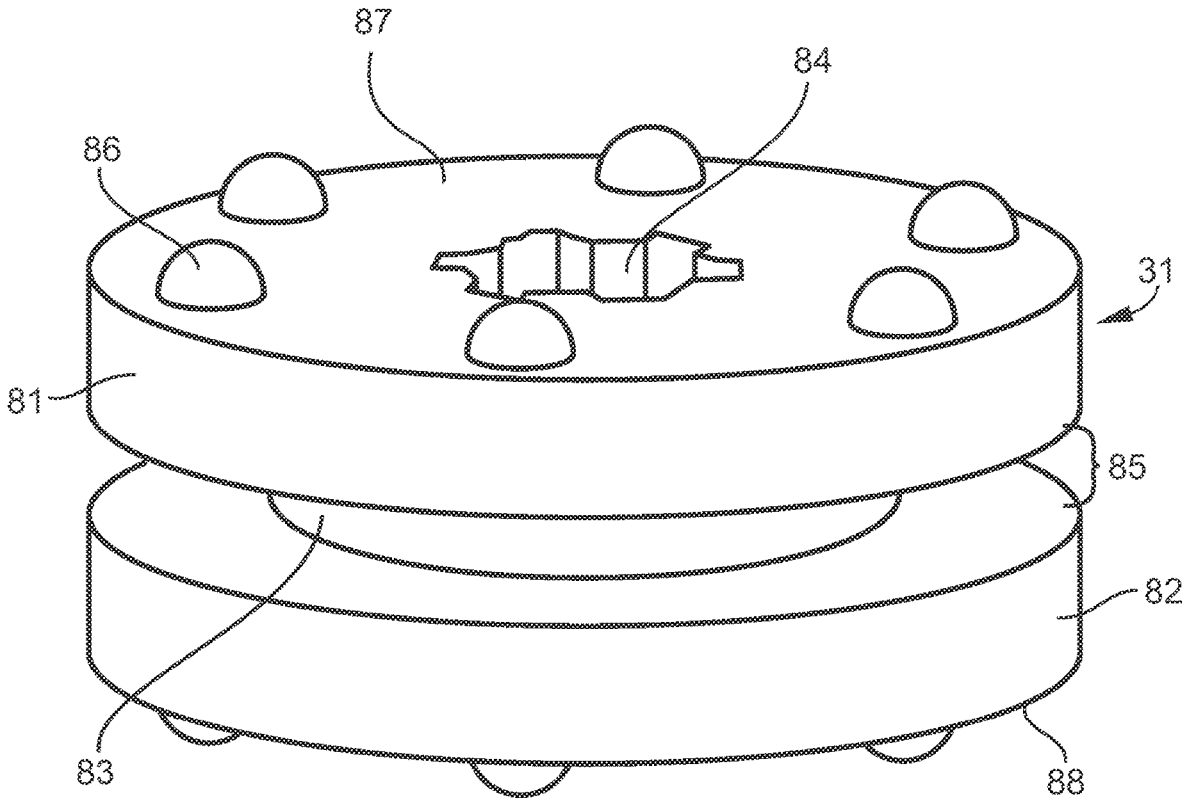
FIG. 8 is a perspective view of an exemplary dart.

FIG. 8 shows one embodiment of a grommet 31. The grommet 31 includes an upper disc 81, a lower disc 82, and a tube 83 holding upper disc 81 and lower disc 82 at a distance 85 from each other. A channel 84 runs along tube 83 and through upper disc 81 and lower disc 82. Optional nubs 86 may be present, in some embodiments, on an upper surface 87 of upper disc 81 and a lower surface 88 of lower disc 82. Distance 85 is used to house a lower outer rim 35 of the radial fan 24. When the grommets are held in place by the darts, described below, the radial fan 24 is also held in place.

Grommets 31 may be, in some embodiments, made of an elastomeric material, including for example, natural rubbers, styrene-butadiene block copolymers, polyisoprene, polybutadiene, ethylene propylene rubber, ethylene propylene diene rubber, silicone elastomers, fluoroelastomers, polyurethane elastomers, and nitrile rubbers. Use of elastomeric materials for the grommet provide sufficient resiliency to hold the radial fan firmly in place while providing sufficient elasticity to minimize noise.

Figure 6:
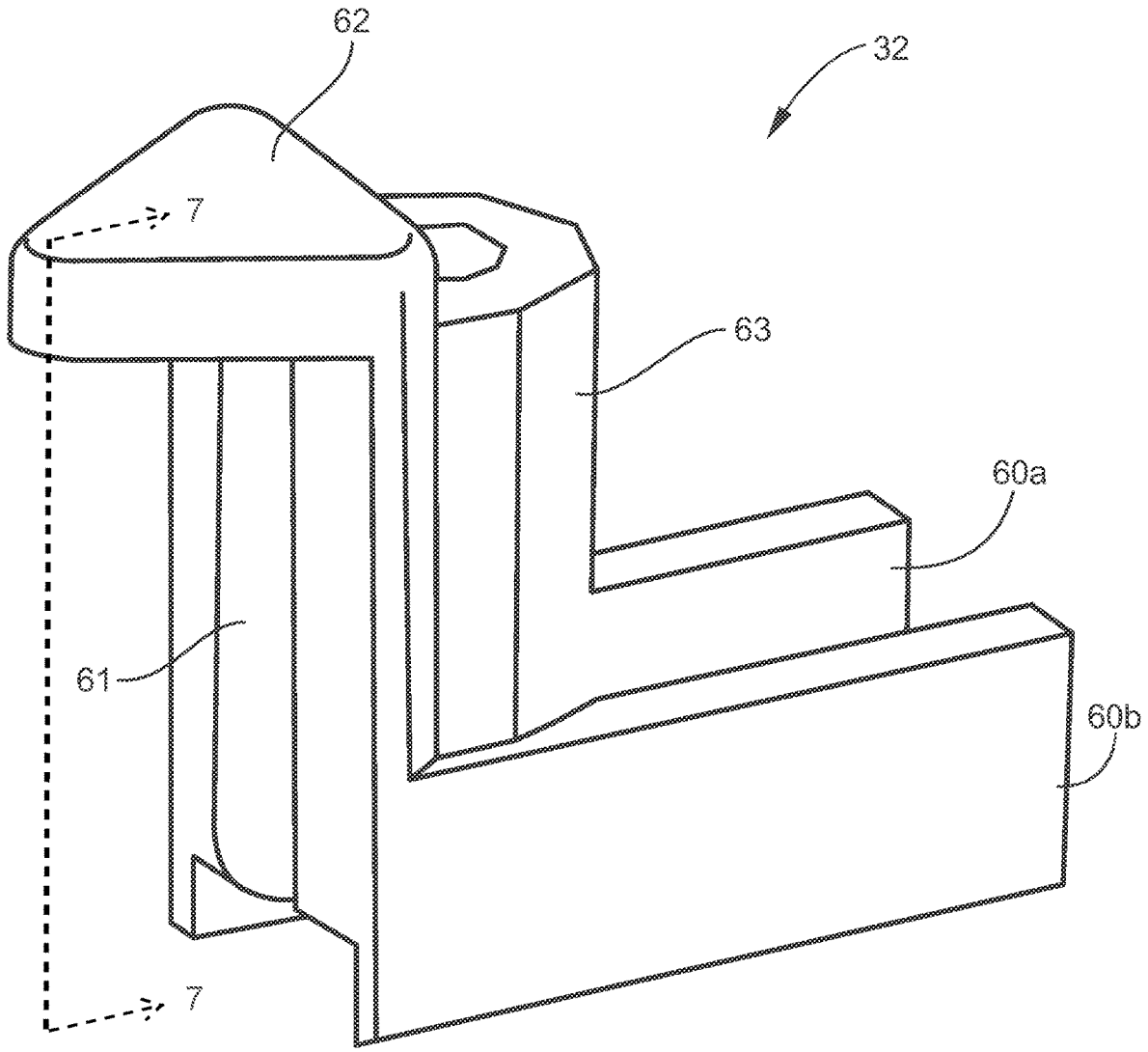
FIG. 6 is a perspective view of one embodiment of a dart.

Referring now to FIG. 6, one embodiment of a dart 32 is shown. The dart 32 includes a horizontal rail 60 from which a vertical rail 61 extends upward. Horizontal rail 60 may be formed by more than one horizontal sub-rails 60*a* and 60*b* running parallel to each other or may be a single horizontal member. The dart 32 further includes a cap 62 covering a top surface of the vertical rail 61. The cap 62 extends outward, away from the horizontal rail 60, and toward the position of the radial fan 24. The cap 62 assists in holding the grommet 31 in place. The dart 32 further includes a support boss 63 extending upwardly from the horizontal rail 60 along a back side of the vertical rail 61. Support boss 63 may provide support to vertical rail 61 and may also be used to supply a back up to the function of the cap 62. Specifically, in some instances of assembly or use, the cap 62 could snap off of vertical rail 61. Should cap 62 break off of a vertical rail 61, grommet 31 could move upward and off of the vertical rail 61. In order to prevent the need for full replacement of the evaporator coil cover in such event, a washer may be affixed to the top surface of the vertical rail 61 to act in place of the cap 62, holding the grommet 31 in place. Channel 84 of grommet 31 and vertical rail 61 are configured or shaped such that vertical rail 61 fits in and through channel 84. Dart 32 may be integrally molded onto an interior surface 69 of evaporator coil cover 22, or alternatively, may be removably or permanently fastened to the evaporator coil cover 22.

Figure 7:
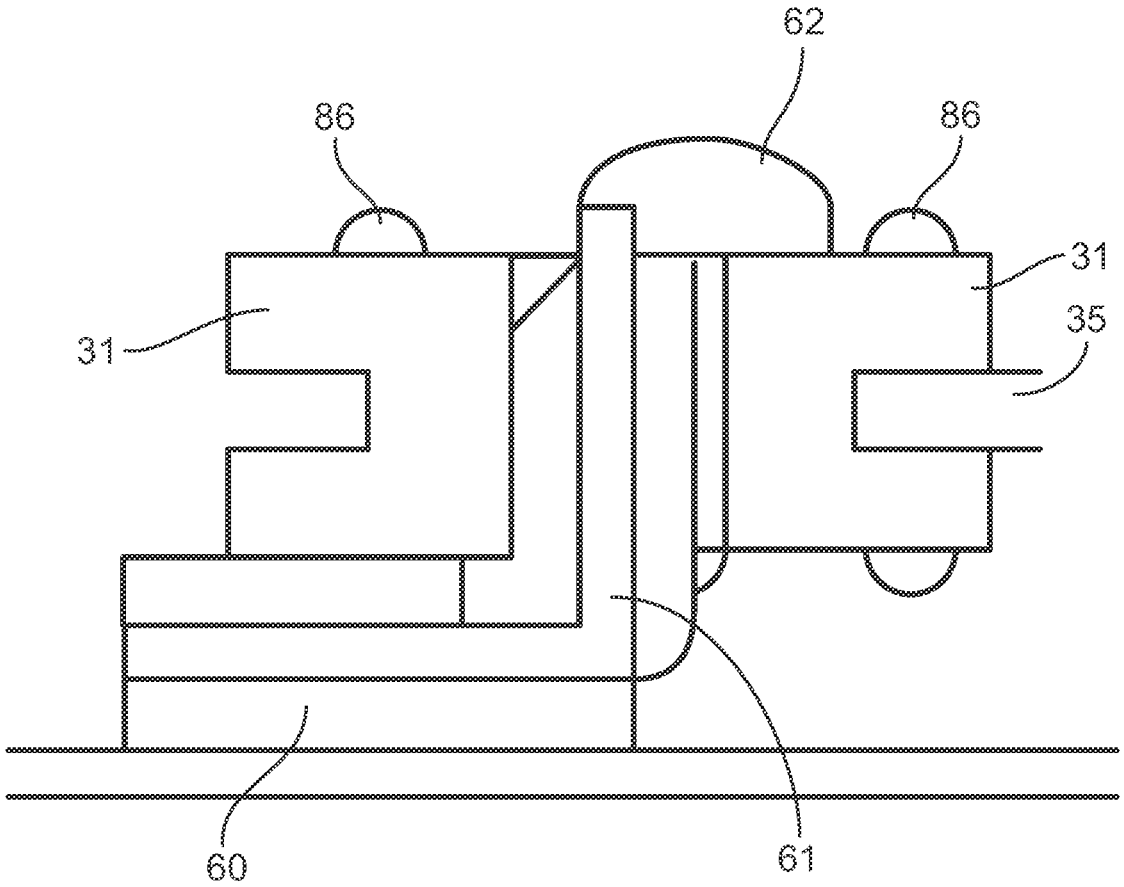
FIG. 7 is cross sectional view of a dart and grommet taken along a longitudinal axis of the dart.

FIG. 7 is a vertical cross sectional view of dart 32 with a grommet 31 installed on the dart 32, the cross section taken along line 7-7 in Fig.

Figure 5:
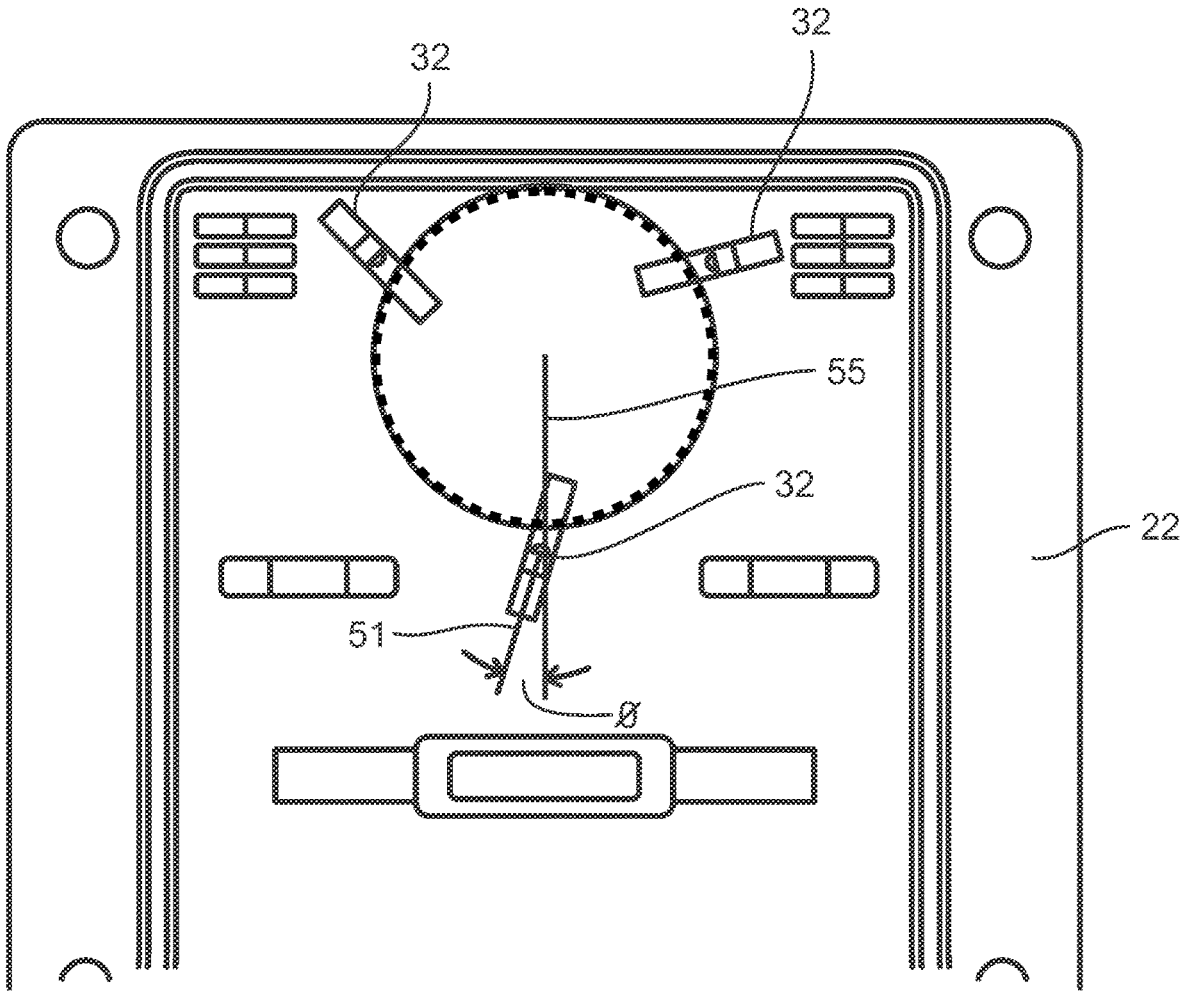
FIG. 5 is a front elevational view of an evaporator coil cover and darts used in the fan assembly shown in FIG. 4 and showing the outer circumference of the radial fan in dashed line.

Referring now to FIG. 5, another optional aspect of the inventive fan assembly is shown. An evaporator coil cover is illustrated with three darts 32. Dotted lines illustrate the outer circumference 52 of the radial fan 24, not shown in FIG. 5. Darts 32 have a horizontal axis 51 along a center of the horizontal rail 60. In some embodiments of the inventive fan assembly, one or all of the horizontal rails 60 are installed such that horizontal axis 51 is at an angle, $\phi$, of from 5 to 30 degrees to a normal line 55 to the circumference 52 of the radial fan 24. All individual values and subranges from 5 to 30 degrees are disclosed and included herein. For example, angle, $\phi$, may range from a lower limit of 5, 10, 15 or 20 degrees to an upper limit of 15, 20, 25, or 30 degrees. For example, angle, $\phi$, may range from 5 to 30 degrees, or in the alternative from 1 to 25 degrees, or in the alternative from 20 to 30 degrees, or in the alternative from 13 to 28 degrees. Angle, $\phi$, may be 20, 24, 24.8, 25, or 26 degrees.

The invention further provides a method of reducing noise in a refrigeration appliance. The inventive method includes the steps of providing a radial fan; housing the radial fan in a mounting assembly which comprises an air duct and an evaporator coil cover. Darts, as described herein, are provided on an interior surface of the evaporator coil cover. The air duct includes a ring portion which interlocks with the evaporator coil cover around the radial fan, as described herein. The evaporator coil cover comprises at least three integrally formed darts positioned substantially uniformly around the radial fan position. The radial fan is attached to the evaporator coil cover by way of at least three elastomeric grommets, each grommet having a central opening configured to fit over a dart, each grommet having a circumferential ridge configured to interlock with a lower rim or the radial fan. Each dart is positioned at an angle of from 5 to 30 degrees with respect to a normal to an outer circumference of the radial fan.

In some embodiments, the inventive method further includes a step of varying the speed of the radial fan. In one embodiment, the inventive method further comprises cycling the radial fan on and off.

The inventive fan assembly provides one or more benefits, including complexity reduction by minimizing the number of parts in the fan assembly, noise reduction by use of the dart and grommet mounting, and improved food freshness by way of optimizing airflow by use of the radial fan and air duct.

The inventive fan assembly and method of reducing noise in a refrigerating appliance may be used in any refrigerating appliance, including for example, domestic or household refrigerators. The household refrigerator may take any form, including for example, French Door bottom mount refrigerators, top mount refrigerator, stand alone refrigerator and freezer units, and multi-door refrigerators.

Those skilled in the art should recognize that although in detail herein, have been shown and described, a plurality of exemplary embodiments of the present invention, however, without departing from the spirit and scope of the invention, according to the present disclosure may still content directly determine or derive numerous other variations or modifications consistent with the principles of the present invention. Accordingly, the scope of the invention should be recognized and understood to cover all such variations or modifications other.

What is claimed is:

1. A fan assembly comprising:

an air duct comprising an opening on an exterior surface;

an evaporator coil cover comprising a plurality of interlocking clips, whereby the air duct is mounted to the evaporator coil cover without the use of screws via said clips;

a radial fan mounted onto the evaporator coil cover and disposed between the air duct and the evaporator coil cover, the radial fan being in alignment with the opening of the air duct;

wherein the air duct includes a ring portion that projects from an interior surface of the air duct around the opening, wherein the ring portion interlocks with the evaporator coil cover around the radial fan such that the air duct is mounted to the evaporator coil cover around the radial fan without the use of screws;

wherein the evaporator coil cover comprises three darts positioned uniformly around the radial fan; and three grommets directly coupled to the radial fan, each grommet having a central opening configured to fit over the three darts, respectively, each grommet having a circumferential ridge interlocking with a lower rim of the radial fan such that the radial fan is mounted to the evaporator coil cover without the use of screws when the grommets are installed on the darts.

2. The fan assembly of claim 1, wherein each dart is positioned at an angle of from 5 to 30 degrees with respect to a normal to an outer circumference of the radial fan.

3. The fan assembly of claim 1, wherein each dart is positioned at an angle of from 15 to 25 degrees with respect to a normal to an outer circumference of the radial fan.

4. The fan assembly of claim 1, wherein the grommets are made of an elastomer material.

5. The fan assembly of claim 4, wherein the horizontal rail is integrally formed onto the evaporator coil cover and the vertical rail is integrally formed with the horizontal rail.

6. The fan assembly of claim 1, wherein the grommets are made of rubber.

7. The fan assembly of claim 1, wherein the darts comprise a horizontal rail from which a vertical rail extends upward, a cap covering a top surface of the vertical rail and extending inwardly toward the radial fan past the vertical rail, such that the cap assists in holding the grommet in place, and a support boss extending upwardly from the horizontal rail along a back portion of the vertical rail.

8. The fan assembly of claim 1, wherein the air duct is made of expanded polystyrene.

9. The fan assembly of claim 1, wherein the air duct is made of expanded polypropylene.

10. The fan assembly of claim 1, wherein the ring portion of the air duct comprises said opening.

11. The fan assembly of claim 10, wherein the opening of the air duct has a diameter of between 50 and 100 mm.

12. The fan assembly of claim 10, wherein a depth of the ring portion of the air duct is between 1 and 12 mm.

13. A refrigerator comprising the fan assembly of claim 1.

* * * * *